US010920477B2

(12) United States Patent
Akgor et al.

(10) Patent No.: US 10,920,477 B2
(45) Date of Patent: Feb. 16, 2021

(54) SLIDING DOOR WITH WIRELESS-CONTROLLED MOTOR HOUSED IN JAMB

(71) Applicants: Yasemin Akgor, Cesme/ Izmir (TR); Toygan Tunca, Manisa (TR); Naci Gul, Izmir (TR); Mustafa Gul, Basin Sitesi Izmir (TR); Rawad Rhayem, Palmetto Bay, FL (US)

(72) Inventors: Yasemin Akgor, Cesme/ Izmir (TR); Toygan Tunca, Manisa (TR); Naci Gul, Izmir (TR); Mustafa Gul, Basin Sitesi Izmir (TR); Rawad Rhayem, Palmetto Bay, FL (US)

(73) Assignees: Yasemin Akgor, Cesme/Izmir (TR); Naci Gul, Izmir (TR); Mustafa Gul, Basin Sitesi Izmir (TR); Rawad Rhayem, Palmetto Bay, FL (US)

( * ) Notice: Subject to any disclaimer, the term of this patent is extended or adjusted under 35 U.S.C. 154(b) by 35 days.

(21) Appl. No.: 16/158,815

(22) Filed: Oct. 12, 2018

(65) Prior Publication Data

US 2020/0115947 A1 Apr. 16, 2020

(51) Int. Cl.
*E05F 15/643* (2015.01)
*E05F 15/662* (2015.01)
(Continued)

(52) U.S. Cl.
CPC ..... *E05F 15/643* (2015.01); *E05D 15/0652* (2013.01); *E06B 3/4618* (2013.01);
(Continued)

(58) Field of Classification Search
CPC ... E05F 15/643; E05F 15/662; E05Y 2600/45
(Continued)

(56) References Cited

U.S. PATENT DOCUMENTS 3,303,616 A * 2/1967 Brown ..... E04B 1/0023 52/213
3,343,302 A * 9/1967 Browning ..... E05F 17/001 49/18
(Continued)

FOREIGN PATENT DOCUMENTS

DE 102016123800 A1 * 6/2018 ..... E05F 15/635
EP 2169170 A2 * 3/2010 ..... A47K 15/643
(Continued)

OTHER PUBLICATIONS

Frame Assembly and Installation Guide for Andersen® 400 Series Frenchwood®, 200 Series Narroline®, 200 Series Perma-Shield® Gliding Patio Doors and Stationary Sidelights; and 200 Series Perma-Shield Gliding Patio Doors with PG Upgrade, Andersen® Windows and Doors, 0005310, (34 pages) Jan. 17, 2018.
(Continued)

*Primary Examiner* — Robert Canfield
(74) *Attorney, Agent, or Firm* — Gordon & Jacobson, P.C.

(57) ABSTRACT

A sliding door assembly includes a frame that supports and interfaces directly to a fixed door panel and a moving door panel. The frame includes opposed side jamb portions, a sill portion, and head jamb portion opposite the sill portion. The door assembly includes an electric motor, a wireless motor controller, and a drive belt that is operably coupled to the moving door panel. The drive belt is driven by the electric motor under control of the wireless motor controller. The head jamb portion includes at least one internal channel that accommodates the drive belt. One of the side jamb portions has a first internal compartment that houses the electric motor and the wireless motor controller.

14 Claims, 15 Drawing Sheets

(51) Int. Cl.
*E05F 15/77* (2015.01)
*E05D 15/06* (2006.01)
*E06B 3/46* (2006.01)

(52) U.S. Cl.
CPC ..... *E06B 3/4636* (2013.01); *E05F 15/662* (2015.01); *E05Y 2600/45* (2013.01); *E05Y 2900/132* (2013.01)

(58) Field of Classification Search
USPC ..... 49/324, 360, 61–63, 125
See application file for complete search history.

(56) References Cited

U.S. PATENT DOCUMENTS 4,050,189 A * 9/1977 Peterson ..... E05D 15/06 49/26
4,893,435 A * 1/1990 Shalit ..... E05F 15/643 49/139
5,039,925 A * 8/1991 Schap ..... E05B 81/22 318/282
5,422,552 A * 6/1995 Parisi ..... E05F 15/652 318/466
6,058,635 A * 5/2000 Morris ..... G09F 13/04 40/544
6,289,643 B1 * 9/2001 Bonar ..... E06B 3/4654 49/505
6,918,210 B1 * 7/2005 Smiley ..... E05F 15/643 49/347
8,544,215 B2 * 10/2013 Gazda ..... E05D 15/0656 52/64
8,959,836 B2 * 2/2015 Gayhart ..... E05B 65/0017 49/141
2006/0005485 A1 * 1/2006 Epps ..... G10L 15/26 52/204.51
2008/0250716 A1 * 10/2008 Ranaudo ..... E05B 65/06 49/31
2010/0095596 A1 * 4/2010 Luca ..... A47K 3/34 49/360
2011/0245978 A1 * 10/2011 Farrell ..... E05F 15/614 700/275
2012/0260575 A1 * 10/2012 Monaco ..... E05F 15/668 49/13
2014/0041305 A1 * 2/2014 Gazda ..... E05D 15/0656 49/360
2014/0331557 A1 * 11/2014 Bruns ..... E05F 15/603 49/25
2015/0013227 A1 * 1/2015 Lamb ..... E05F 15/79 49/25
2016/0047158 A1 * 2/2016 Raap ..... E06B 3/44 49/31
2018/0044966 A1 * 2/2018 Brand ..... E05F 15/643
2019/0162009 A1 * 5/2019 Hall ..... E05F 15/72

FOREIGN PATENT DOCUMENTS

EP 2270302 A2 * 1/2011 ..... E05F 15/643
WO WO-2018104218 A1 * 6/2018 ..... E05F 15/643

OTHER PUBLICATIONS

Panel Assembly and Installation Guide or Andersen® 400 Series Frenchwood®, 200 Series Narroline®, 200 Series Perma-Shield® Gliding Patio Doors and Stationary Sidelights; and 200 Series Perma-Shield Gliding Patio Doors with Performance Grade (PG) Upgrade, Andersen® Windows and Doors, 0005309 (40 pages) Jan. 17, 2018.
Rough Opening Preparation for Andersen® Frenchwood® Outswing Patio Doors Installation Guide, Anderson® Windows and Doors, 0004255 (2 pages) Feb. 3, 1999.
Sliding Door Automatic Control Installation Instruction; Marvin Windows and Doors, 19915616, (13 pages) Nov. 24, 2016.

* cited by examiner

SLIDING DOOR WITH WIRELESS-CONTROLLED MOTOR HOUSED IN JAMB

BACKGROUND

1. Field

The present disclosure relates to doors, and, more specifically, to motorized sliding doors.

2. State of the Art

FIG. 1 shows a portion of a wood framed building structure 100, which defines a rough opening 102 that is configured to receive a sliding door frame (e.g., 300 in FIG. 3) of a sliding door assembly (not shown). FIG. 2 shows a portion of a brick building structure 200, which defines a rough opening 202 that is configured to receive a sliding door frame (e.g., 300 in FIG. 3) of a sliding door assembly (not shown). In FIGS. 1 and 2, wood lines the sides (studs) and top (header) of the rough openings 102 and 202. The rough openings 102 and 202 are prepared and configured to receive and connect to the sliding door frame 300.

FIG. 3 shows components of sliding door frame 300. The door frame 300 includes a top head jamb 302, two opposed side jambs 304, and a bottom sill 306 opposite the head jamb 302. The frame 300 may be provided with side installation flanges 308 to connect the side jambs 304 to the sides (e.g., studs) of a rough opening (e.g., 102, 202). Similarly, the frame 300 may be provided with a head installation flange 310 to connect the head jamb 302 to the top (e.g., header) of a rough opening (e.g., 102, 202). The sill 306 is configured to sit on the bottom (e.g., floor) of a rough opening (e.g., 102, 202) and be connected thereto. The head jamb 302 has parallel aligned channels 312 or tracks that receive door panels (not shown). Connections between the frame 300 and a rough opening (e.g., 102, 202) may be accomplished using screws and/or adhesive, or other fasteners known in the art.

Some sliding doors are manually operated, while others may be motorized. Some motorized sliding doors, such as those used in some commercial buildings (e.g., shopping centers and hospitals), have at least one moving door panel that slides along a track relative to a door frame. The movement of the moving door panel is driven by a motor that is completely separate from the door frame and which is typically located above or to one of the sides of the door frame, in a separate space defined by the building structure (e.g., between two studs of a building wall or above a header beam of the building). An example of one motorized sliding door is the Marvin Sliding Door Automatic Control (SDAC) system, available from Marvin Windows and Doors of Warroad, Minn. Such a system requires an installer to locate the motor in a cavity in the building structure and spaced remotely from the frame of the sliding door. This, then, requires that the installer has access to such a cavity. In the case of a rough opening adjacent to finished walls (i.e., painted or wallpapered drywall), creating access to such a cavity between studs of the wall may entail demolishing and restoring large portions of the finished drywall. In the case of masonry or brick interior walls adjacent to the rough opening, creating access for the motor may entail demolishing and restoring portions of the brick or masonry.

SUMMARY

According to one aspect, further details of which are described hereinbelow, a sliding door assembly includes a frame that supports and interfaces directly to a fixed door panel and a moving door panel. The frame includes opposed side jamb portions, a sill portion, and head jamb portion opposite the sill portion. Also, the sliding door assembly includes an electric motor, a wireless motor controller, and a drive belt that is operably coupled to the moving door panel. The drive belt is driven by the electric motor under control of the wireless motor controller. The head jamb portion includes at least one internal channel that accommodates the drive belt. One of the side jamb portions has a first internal compartment that houses the electric motor and the wireless motor controller.

In embodiments, the sliding door assembly further includes a removable access panel that is removably fixed to the one side jamb portion having the internal compartment that houses the electric motor and the wireless motor controller. The access panel has a first configuration where the access panel is fixed to the one side jamb portion and covers at least part of the internal compartment that houses the electric motor and the wireless motor controller. The access panel may have a second configuration where the access panel is disconnected from the one side jamb portion to allow access to the internal compartment and to the electric motor and the wireless motor controller housed therein.

In embodiments, the sliding door assembly further includes first and second guide pulleys that guide movement of the belt between two fixed points that are spaced apart from one another and aligned with the at least one internal channel of the head jamb portion. A particular one of the first and second guide pulleys may be coupled to an output shaft of the electric motor and interfaces to the drive belt such that the drive belt moves in conjunction with rotation of the output shaft of the electric motor. The particular one of the first and second guide pulleys may be housed within the first internal compartment of the one side jamb portion. The one side jamb portion may define at least one window leading into the first internal compartment, where the at least one window allows for passage of the drive belt into the first compartment.

In embodiments, the other one of the side jamb portions has a second internal compartment that houses the other one of the first and second guide pulleys. The other one of the side jamb portions may define at least one window leading into the second internal compartment, where the at least one window allows for passage of the drive belt into the second compartment.

In embodiments, the frame is secured to structural members of a building structure, wherein the structural members provide a four-sided opening that supports the frame.

In embodiments, the wireless motor controller includes an RF interface for wireless communication to a remote device and controller circuitry. The RF interface and controller circuitry cooperate to receive commands for operating the sliding door assembly communicated from the remote device. The wireless motor controller may further include interface circuitry operably coupled between the controller circuitry and the electric motor for electrical control of the electric motor. The electrical motor may comprise a DC motor, and the interface circuitry may comprises an H-bridge switching circuit that is controlled by electrical signals supplied by the controller circuitry. The H-bridge can be used to control the rotational direction of the DC motor, and, thus, the direction of the output shaft of the DC motor. The electrical motor may includes a shaft encoder that supplies feedback signals to the controller circuitry. The feedback signals are used by the controller for electrical control of the electric motor.

In embodiments, the sliding door assembly further includes an electrical power source that supplies DC power signals to the wireless motor controller. The electrical power source may comprise an AC-DC transformer.

According to another aspect of the disclosure, a method of assembling a sliding door assembly having a frame is described. The frame supports and interfaces directly to a fixed door panel and a moving door panel. The frame includes opposed side jamb portions, a sill portion, and head jamb portion opposite the sill portion. The method includes mounting an electric motor and a wireless motor controller to one of the opposed side jamb portions, and coupling the electric motor to a drive belt, and securing a portion of the drive belt to the moving door panel. The drive belt is configured to be driven by the electric motor under control of the wireless motor controller to move the secured portion of the drive belt and the moving door panel.

In embodiments, the coupling of the electric motor includes positioning the drive belt in at least one internal channel of the head jamb portion that accommodates the drive belt. Also, in embodiments, the mounting of the electric motor and the wireless motor controller includes disposing the electric motor and the wireless motor controller inside a first internal compartment of the one of the opposed side jamb portions.

According to yet another aspect of the disclosure, a method of operating a sliding door assembly includes providing a sliding door assembly that includes a frame that supports and interfaces directly to a fixed door panel and a moving door panel. The frame includes opposed side jamb portions, a sill portion, and head jamb portion opposite the sill portion. The provided sliding door assembly also includes an electric motor, a wireless motor controller, and a drive belt that is operably coupled to the moving door panel. The drive belt is driven by the electric motor under control of the wireless motor controller, the head jamb portion includes at least one internal channel that accommodates the drive belt, and one of the side jamb portions has a first internal compartment that houses the electric motor and the wireless motor controller.

The method further includes wirelessly receiving a door movement command to move the door from a first position to a second position. Further, the method includes, in response to receiving the door movement command, applying power to the electric motor to drive the drive belt in a direction to move the moving door in a direction from the first position towards the second position.

BRIEF DESCRIPTION OF THE DRAWINGS

In FIG. 4*a*, the sliding door assembly is shown with a moving door panel in a fully closed position.

DETAILED DESCRIPTION OF THE PREFERRED EMBODIMENTS

Figure 1:
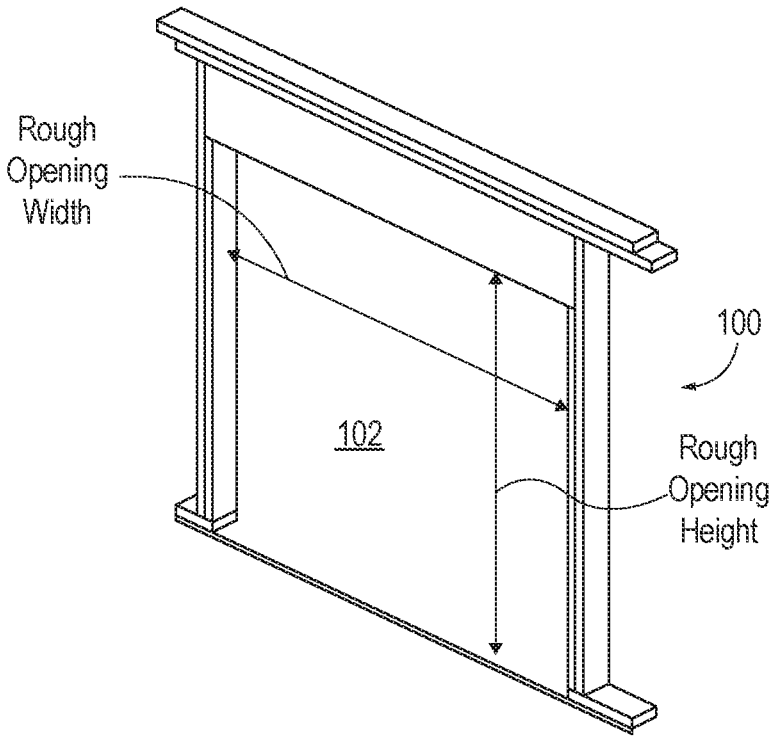
FIG. 1 (PRIOR ART)
FIG. 1 shows a portion of a wooden building structure that defines a rough opening to receive a sliding door assembly.
Figure 2:
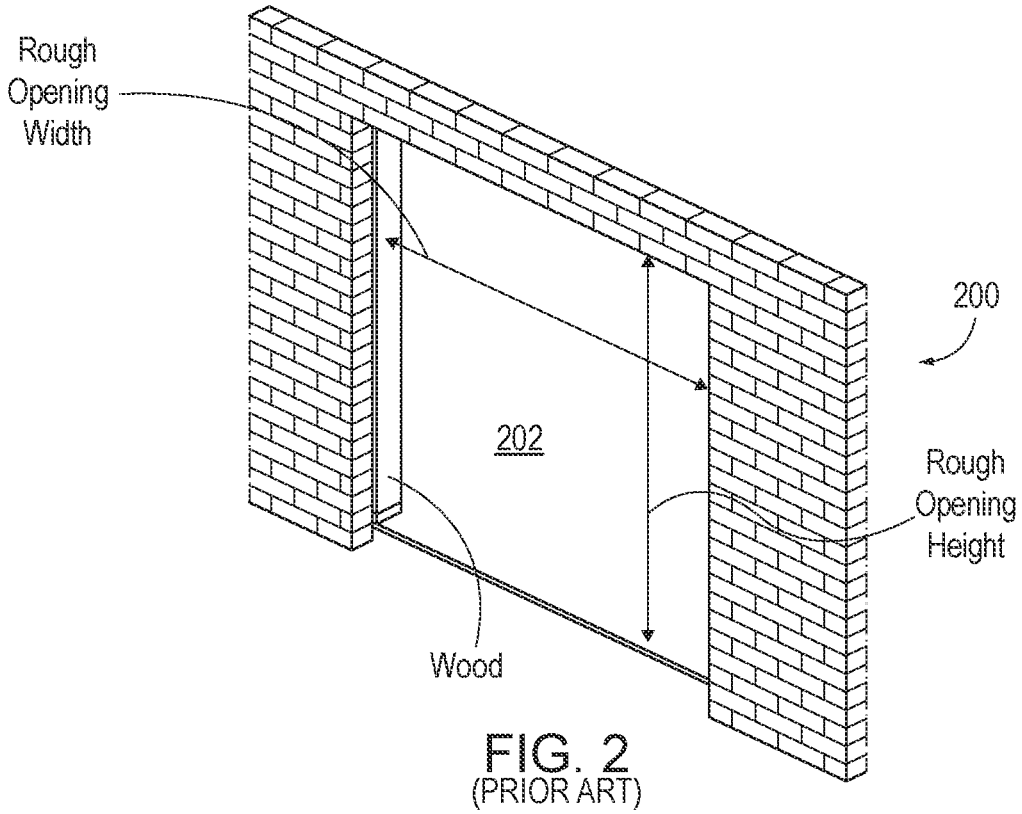
FIG. 2 (PRIOR ART)
FIG. 2 shows a portion of a brick or masonry building structure that defines a rough opening to receive a sliding door assembly.
Figure 3:
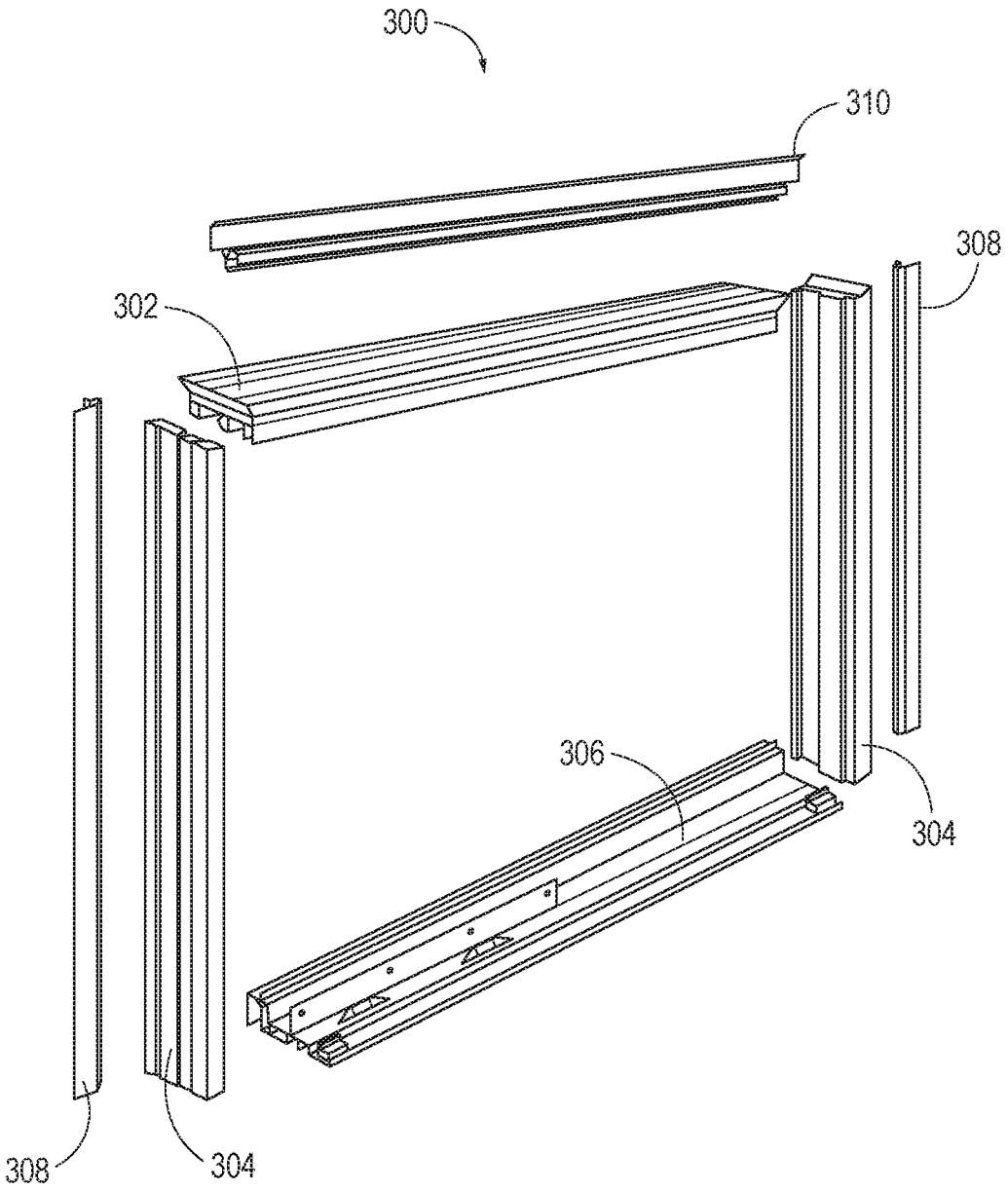
FIG. 3 (PRIOR ART)
FIG. 3 shows an exploded assembly view of portions of a prior art door frame, which can be installed in the rough openings shown in FIG. 1 or 2.
Figure 4A:
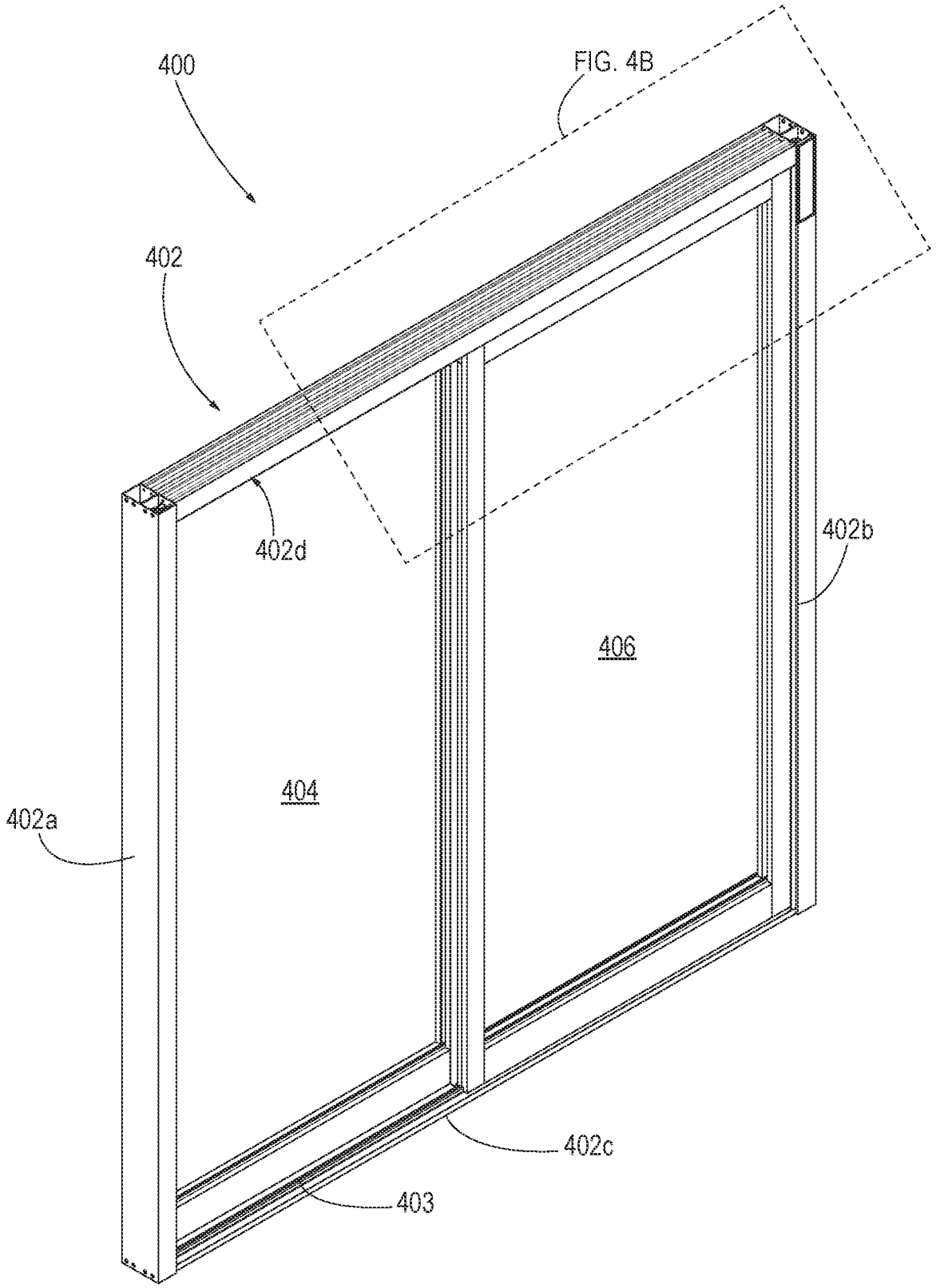
FIG. 4*a* is an isometric view of a sliding door assembly in accordance with an aspect of the disclosure, viewed from a front side, top side, and left side thereof.
Figure 4B:
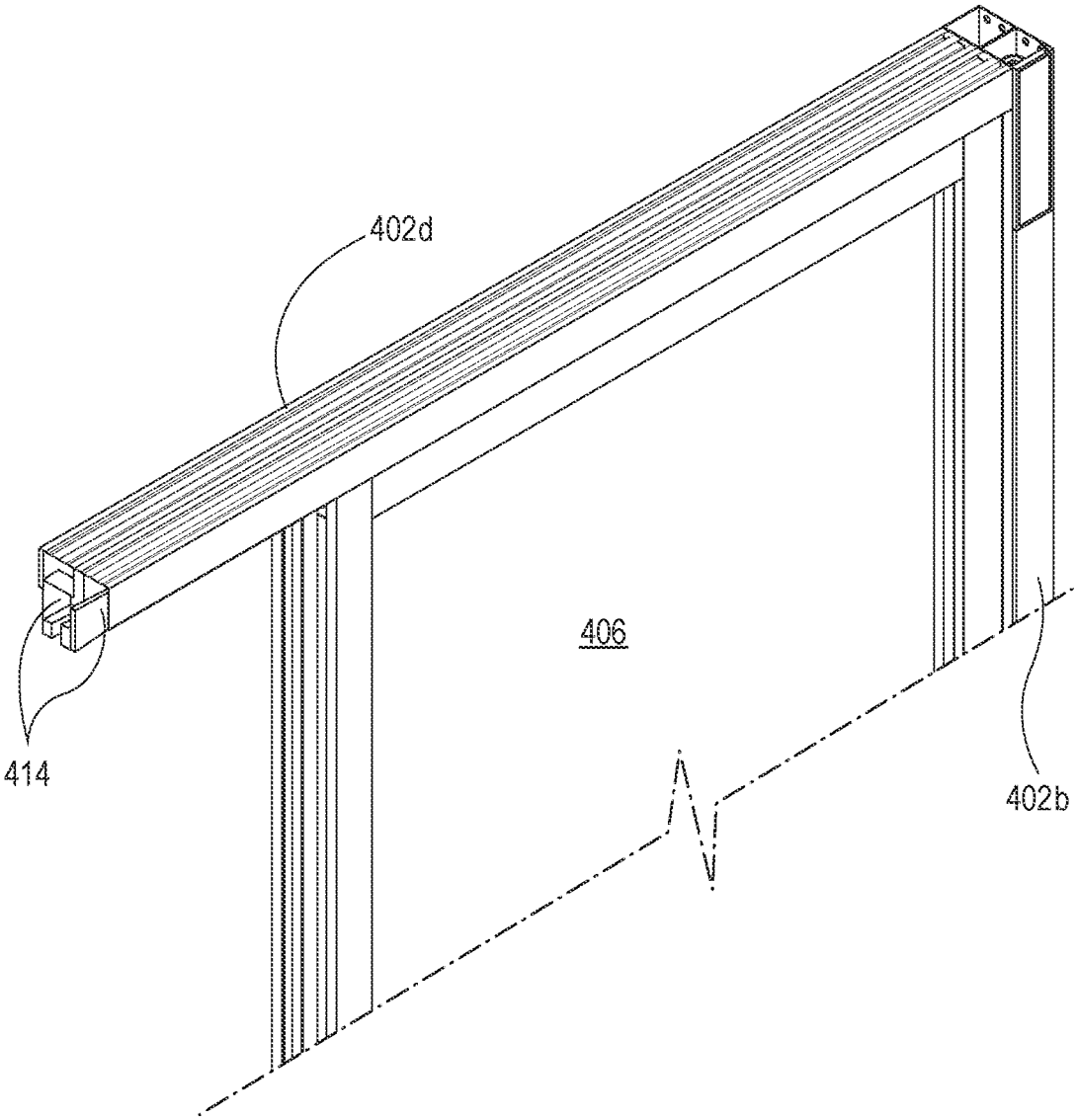
FIG. 4*b* is a detailed cutaway view of a portion of the sliding door assembly shown in FIG. 4*a*.
Figure 4C:
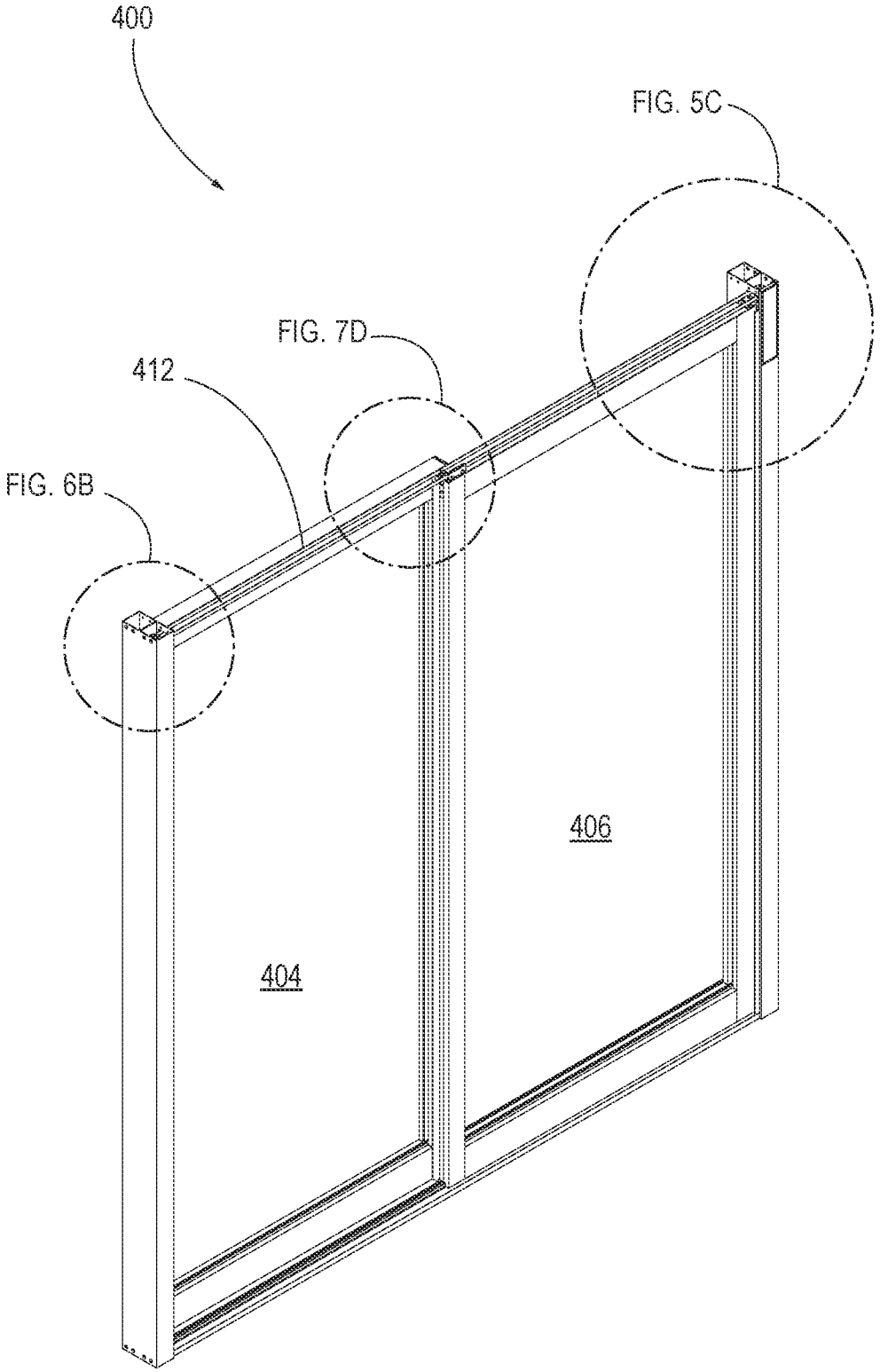
FIG. 4*c* shows the sliding door assembly shown in FIG. 4*a* with a head jamb portion in FIGS. 4*a* and 4*b* removed for clarity of illustration to show a drive belt.

FIGS. 4*a* to 4*c* show various features of an embodiment of a sliding door assembly 400 in accordance with an aspect of the disclosure. The sliding door assembly 400 includes a frame 402 that supports and interfaces directly to a fixed door panel 404 and a moving door panel 406. The frame 400 is configured to be secured to structural members of a building structure (e.g., 100, 200) that define a rough opening (e.g., 102, 202) that supports the frame 400.

The frame 402 is a four sided structure that includes opposed side jamb portions 402*a* (left side jamb portion) and 402*b* (right side jamb portion), a sill portion 402*c*, and head jamb portion 402*d* opposite the sill portion 402*c*. The portions 402*a*-402*d* may be wholly or partially separable members. For example, some or all of the portions 402*a*-402*d* may be welded to one another to form a unitary piece. Alternatively, some or all of the portions 402*a*-402*d* may be removably fastened to each other with removable fasteners, such as screws. The portions 402*a*-402*d* of the frame 400 may be formed of extruded materials, such as aluminum or plastic (e.g., polyvinyl chloride (PVC)). For example, FIG. 4*b* shows extruded profiles of side jamb portion 402*b* and head jamb portion 402*d*, which defines a two extruded channels 414.

The sill portion 402*c* defines a track 403 that supports the fixed door panel 404 and the moving door panel 406. Specifically, the track 403 supports translation of the moving door panel 406 between a fully closed door position (shown in FIG. 4*a*), where the moving door panel 406 is engaged with one side jamb portion (e.g., right side jamb portion 402*b*), and a fully open door position in which the moving door panel 406 is engaged with the opposite side jamb portion (e.g., left side jamb portion 402*a*).

As shown in greater detail in FIG. 4*c*, the sliding door assembly 400 also includes a drive belt 412 that is operably coupled to the moving door panel 406, as will be described in greater detail below. When connected to the frame 402, the at least one internal channel 414 (FIG. 4*b*) of the head jamb portion 402*d* accommodates the drive belt 412 and a clamp arrangement 700 (FIGS. 7*a* to 7*d*), further details of which are described below. Specifically, the one or more channels 414 are configured to accommodate the drive belt 412 and the clamp arrangement 700 and their movement (i.e., translation) in the one or more channels 414 as the moving door panel 406 translates along the track 403.

Figure 5A:
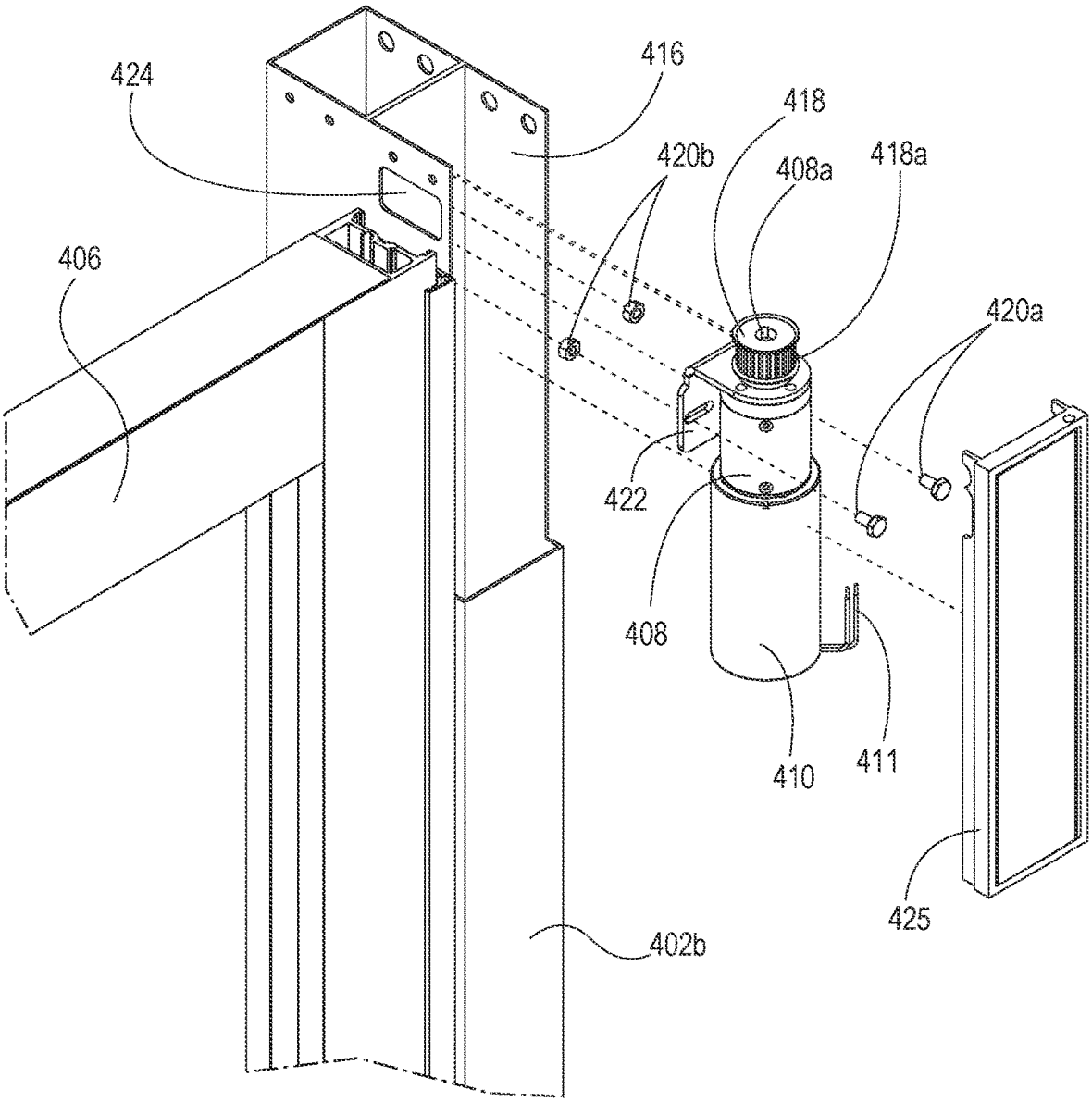
FIG. 5*a* is an exploded assembly view showing details of the portion of FIG. 4*c* labeled "FIG. 5*c*", shown with the drive belt omitted for clarity of illustration.
Figure 5B:
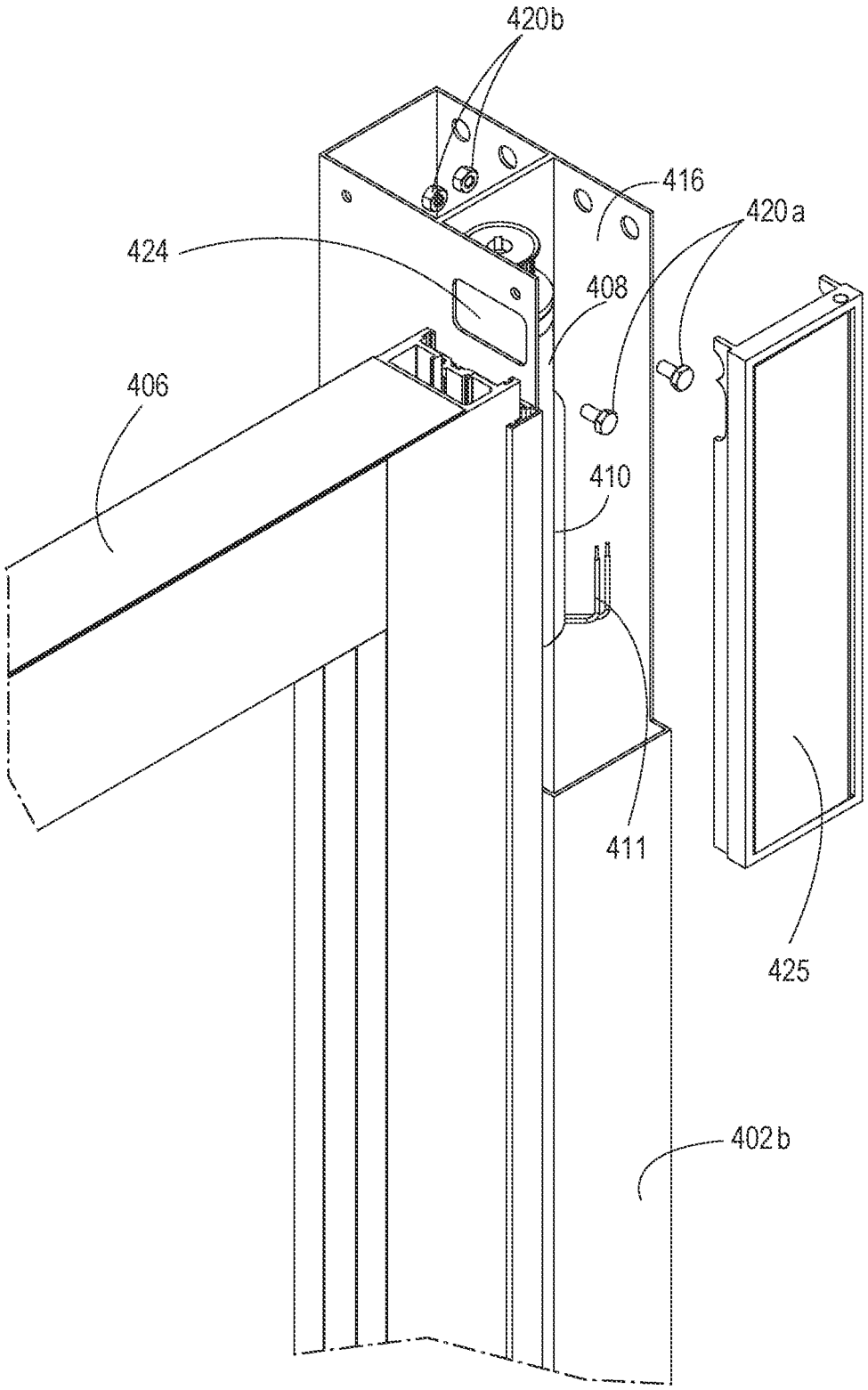
FIG. 5*b* shows the components of FIG. 5*a* in a partially assembled state.

As shown in FIGS. 5*a* and 5*b*, the sliding door assembly 400 further includes an electric motor 408 and a wireless motor controller 410. The side jamb portion 402*b* defines a first internal compartment 416 that houses the electric motor 408 and the wireless motor controller 410. The wireless motor controller 410 has wires 411 (FIGS. 5*a*, 5*b*) for connection to a power source, such as an AC/DC transformer 804 (FIG. 8), which can supply power to the wireless motor controller 410 as well as the electric motor 408.

The motor 408 has an output shaft 408*a* secured to a first guide pulley 418. The motor 408 is configured to drive the output shaft 408*a* and the first guide pulley 418. The first guide pulley 418 is configured to couple with, or otherwise interface to, the drive belt 412, as shown in greater detail in FIG. 5*c*. The drive belt 412 moves in conjunction with rotation of the output shaft 408*a* of the electric motor 408 and the first guide pulley 418. The drive belt 412 is driven by the electric motor 408 under control of the wireless motor controller 410. The first guide pulley 418 may have gear teeth 418*a* that are configured to mesh with mating teeth of the belt 412.

A window or opening 424 may be defined in the inner side of the right side jamb portion 402*b*. Alternatively, the portion 405 shown in broken lines in FIG. 5*c* may be omitted forming a larger opening or window 424. Also, as another alternative, the top of the side jamb portion 402*b* may be at or below the top of the moving door panel 406 and the head jamb portion 402*d* may be longer to extend to the outer side of the side jamb portion 402*b* to cover the first internal compartment 416.

The window 424 is configured to align with the drive belt 412 and one or both of the channels 414, above the top of the moving door panel 406, as well as the top of the fixed door panel 404 (not shown in FIG. 5*a*). The motor 408 and the first guide pulley 418 can be secured inside the first internal compartment 416 to the side jamb portion 402*b* with a bracket 422 and fasteners 420*a* and 420*b* so that the first guide pulley 418 is positioned in alignment with the window 424 and one or both of the channels 414 of the header portion 402*d*. The window 424 allows for passage of the belt 412 to the first compartment 416 and to the first guide pulley 418 housed therein, as shown in greater detail in FIG. 5*c*.

Figure 5C:
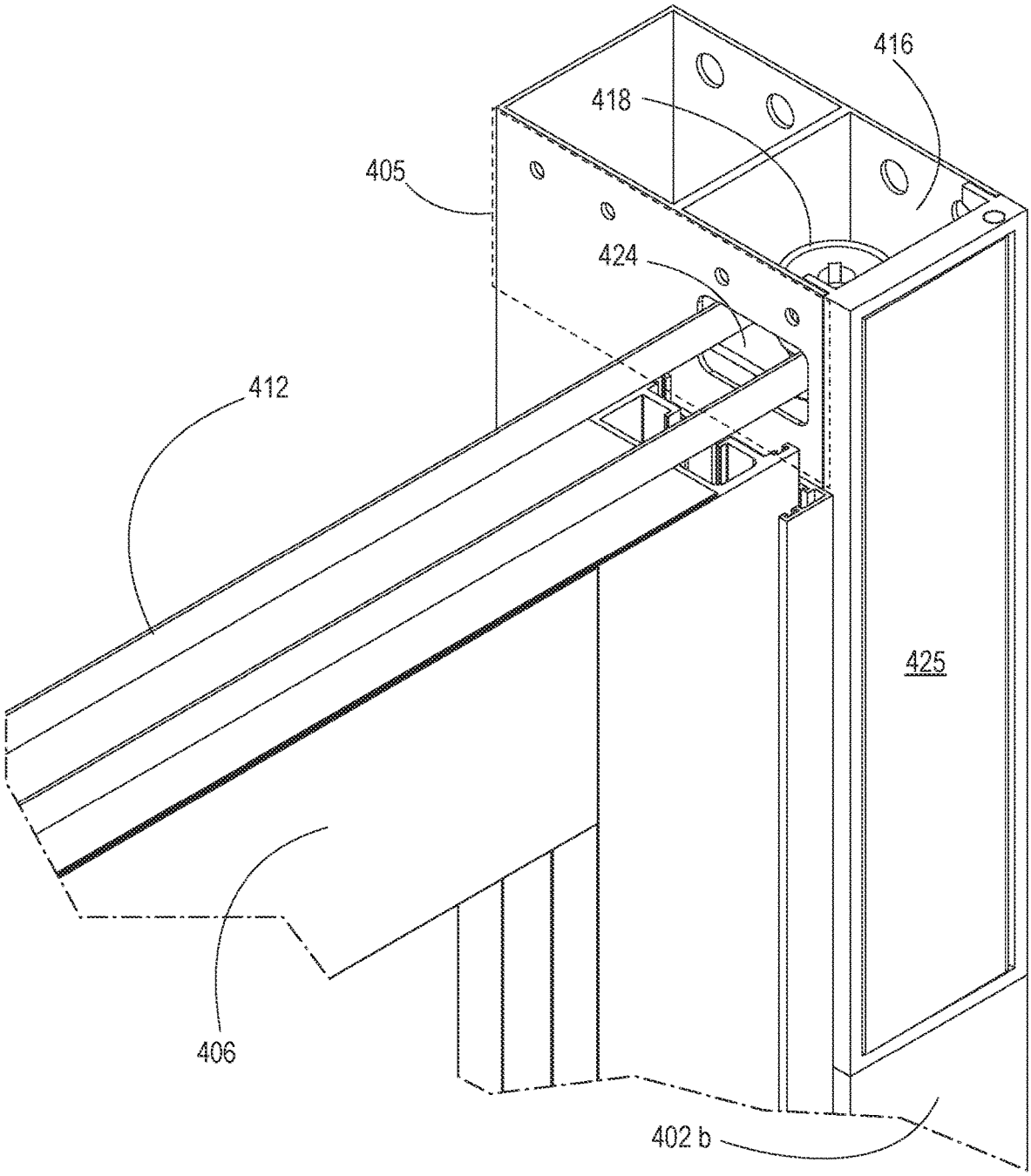
FIG. 5*c* shows the components of FIG. 5*a* in a fully assembled state and coupled to the drive belt as shown in the portion of FIG. 4*c* labeled "FIG. 5*c*".

The sliding door assembly 400 also includes a removable access panel 425 that is removably fixed to the right side jamb portion 402*b*. As shown in FIG. 5*c*, the removable access panel 425 has a first configuration where the access panel 425 is fixed to the right side jamb portion 402*b* and covers at least a portion of the internal compartment 416. Also, as shown in FIGS. 5*a* and 5*b*, the access panel 425 has a second configuration where the access panel 425 is disconnected from the right side jamb portion 402*b* to allow access to the internal compartment 416 and to the electric motor 408, the wireless motor controller 410, and the first guide pulley 418 housed therein.

Figure 6A:
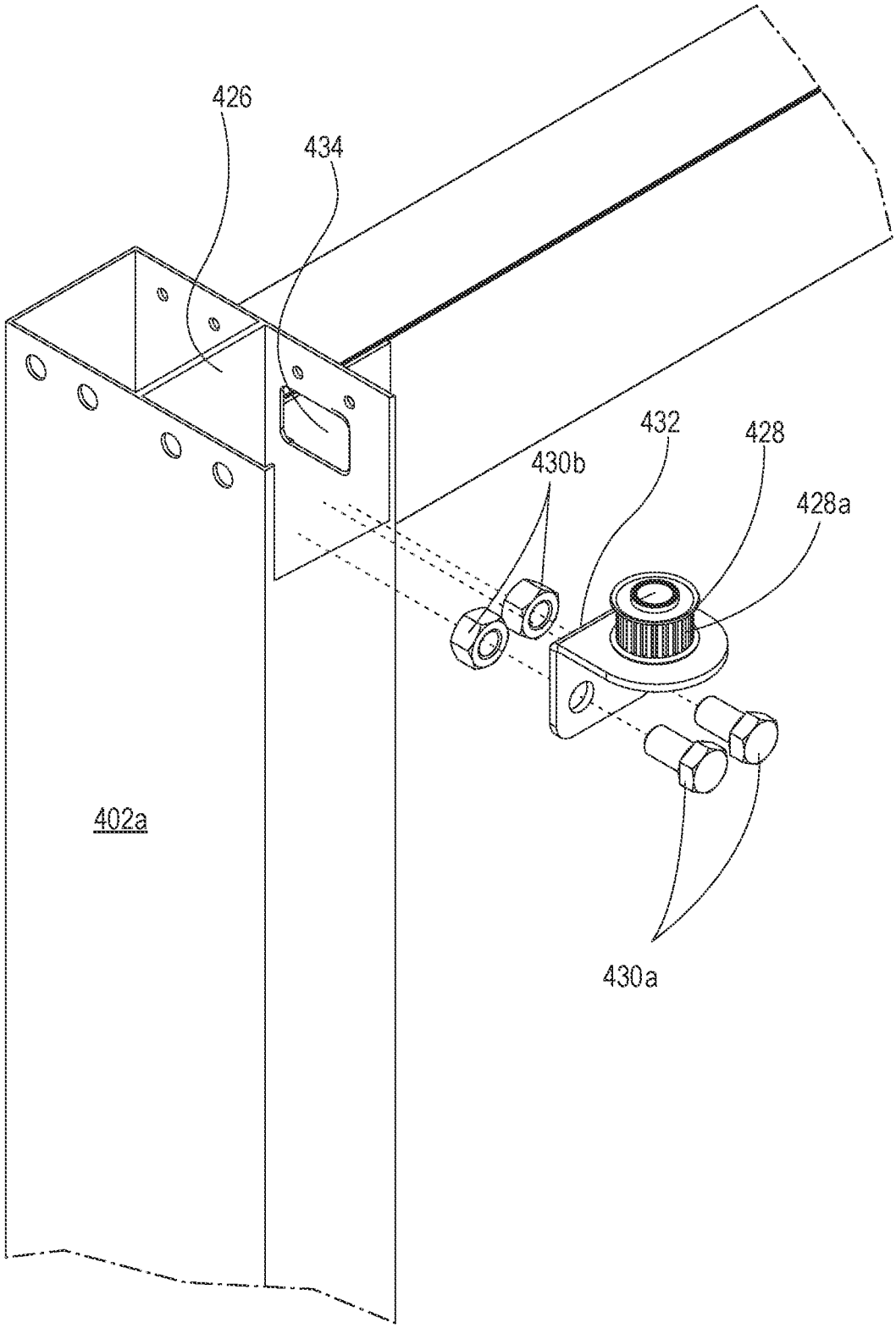
FIG. 6*a* is an exploded assembly view showing details of the portion of FIG. 4*c* labeled "FIG. 6*b*", shown with the drive belt omitted for clarity of illustration.
Figure 6B:
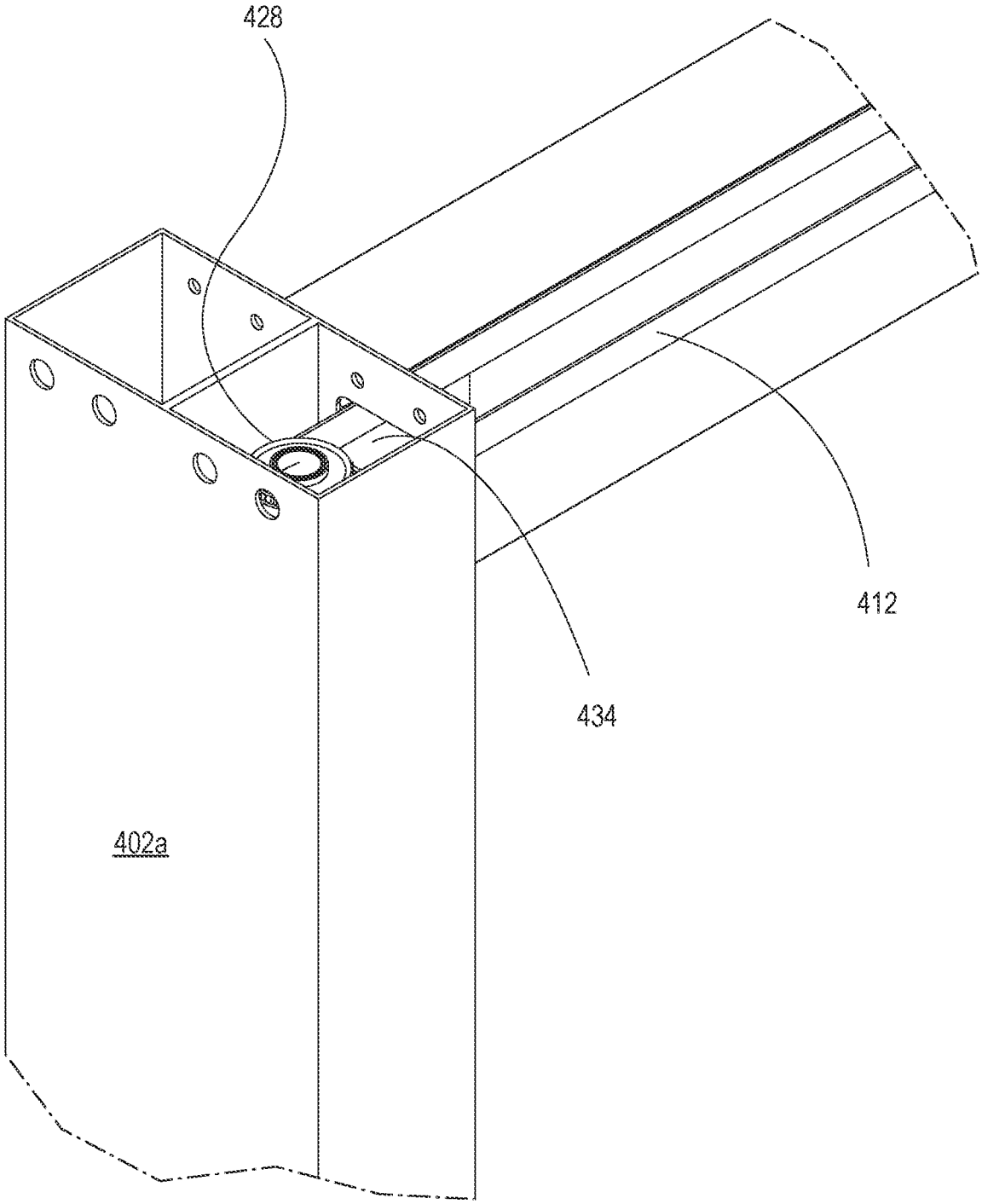
FIG. 6*b* shows the assembly of FIG. 6*a* in an assembled configuration and coupled to the drive belt as shown in the portion of FIG. 4*c* labeled "FIG. 6*b*".

In addition to the first guide pulley 418, the door assembly 400 may also include a second guide pulley 428, shown in FIGS. 4*e* and 6. The first and second guide pulleys 418 and 428 guide movement of the belt 412 between two fixed points that are spaced apart from one another and aligned with the at least one internal channel 414 of the head jamb portion 402*d*. In the embodiment of the door assembly 400, the two fixed points are located in the right and left side jamb portions 402*a* and 402*b*. More specifically, the left side jamb portion 402*b* defines a second internal compartment 426 that houses the second guide pulley 428. The second guide pulley 428 interfaces to the drive belt 412 such that the drive belt 412 moves in conjunction with rotation of the second guide pulley 428. The second guide pulley 428 may have gear teeth 428*a* that mesh with gear teeth of the belt 412, if present.

A window or opening 434 is defined in the inner side of the left side jamb portion 402*a*. The window 434 is aligned with window 424, as well as drive belt 412 and one or both of the channels 414 (not shown in FIG. 6). The second guide pulley 428 is disposed inside the second internal compartment 426 and is secured to the side jamb portion 402*a* with a bracket 432 and fasteners 430*a* and 430*b* so that the second guide pulley 418 is positioned in alignment with the window 434. The window 434 allows for passage of the belt 412 to the second internal compartment 426 and to second guide pulley 428 housed therein.

Figure 7A:
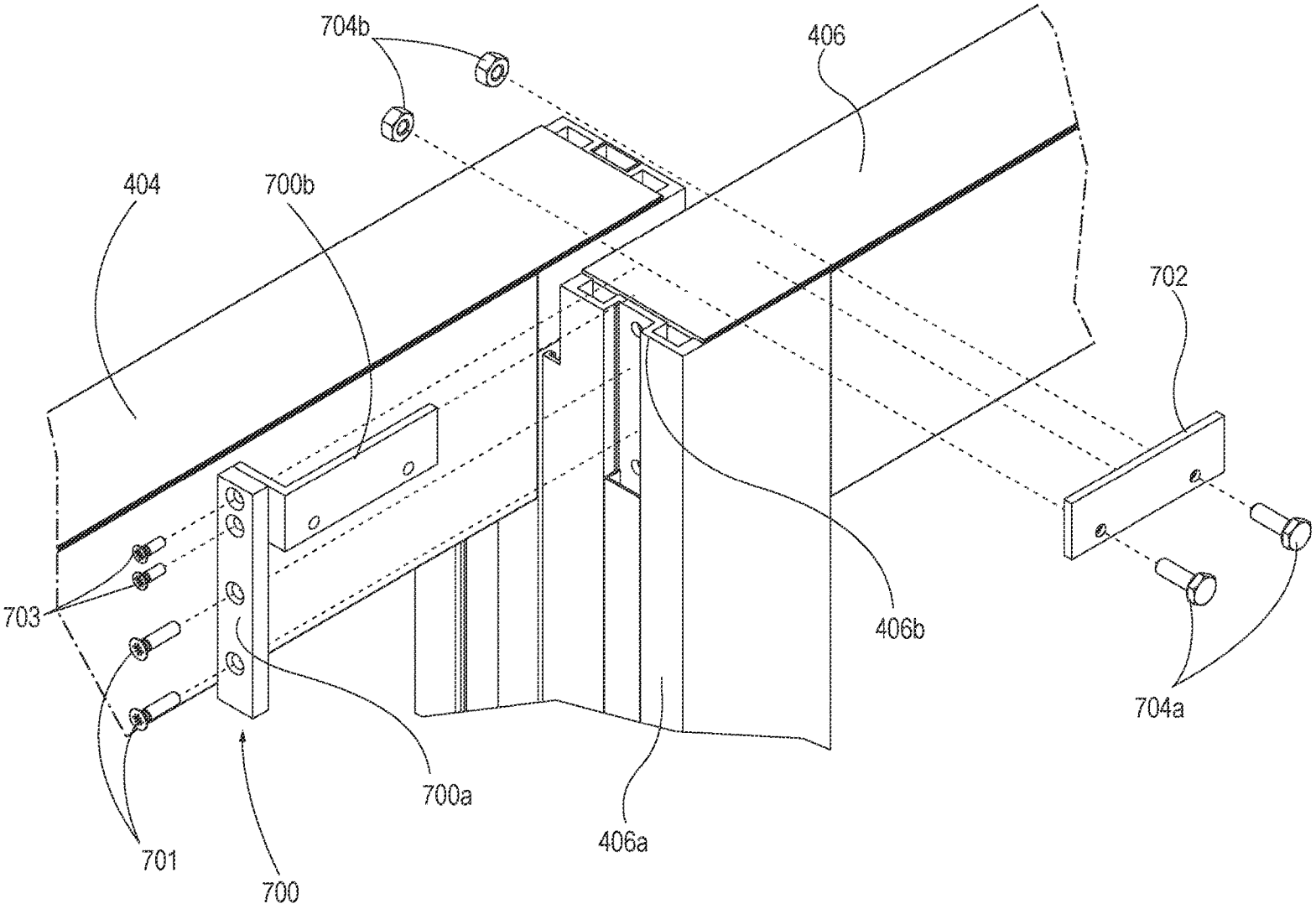
FIGS. 7*a* and 7*b* show exploded assembly views of a clamping arrangement shown in the portion of FIG. 4*c* labeled "FIG. 7*d*", shown with the drive belt omitted for clarity of illustration.
Figure 7B:
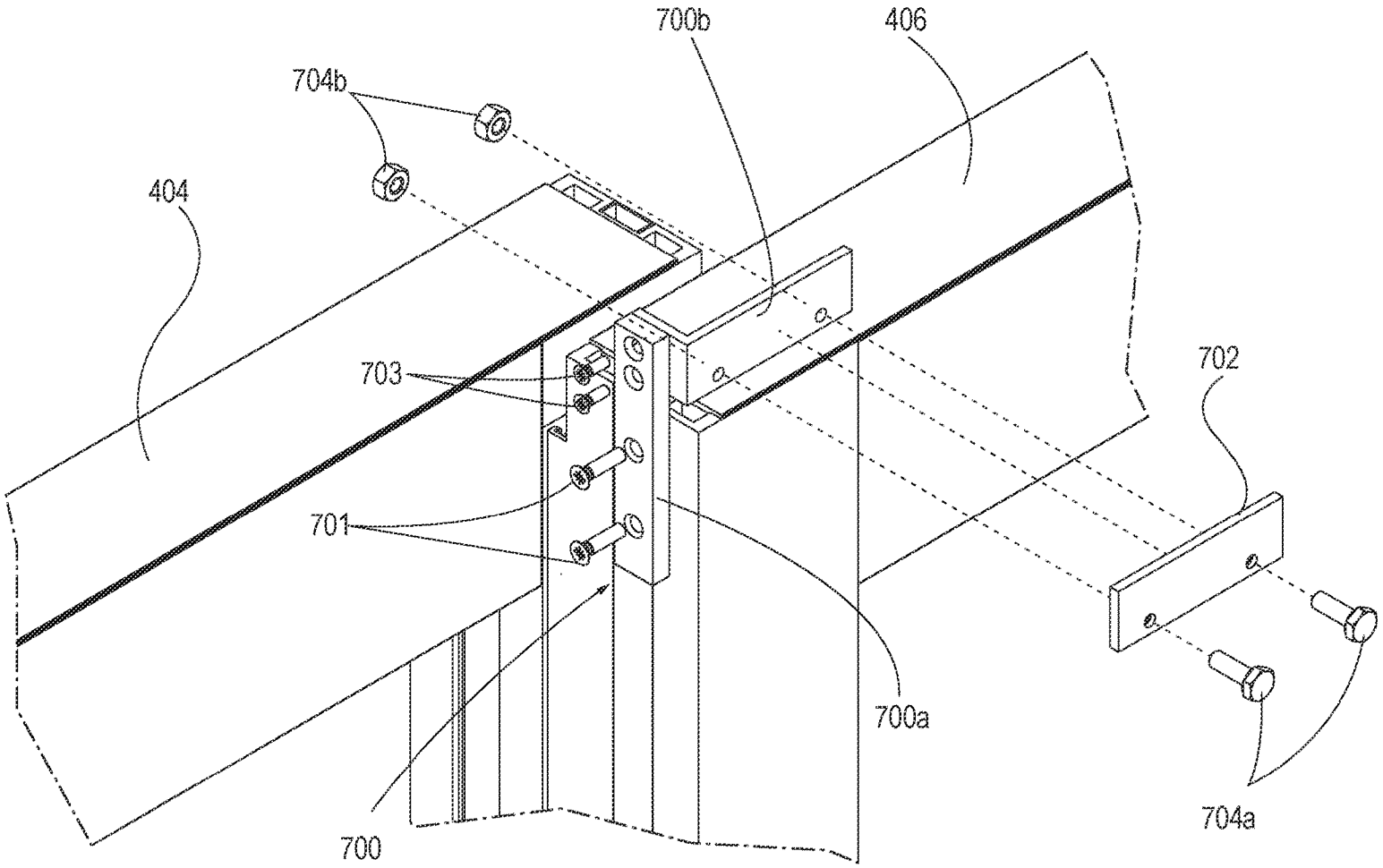
Figure 7C:
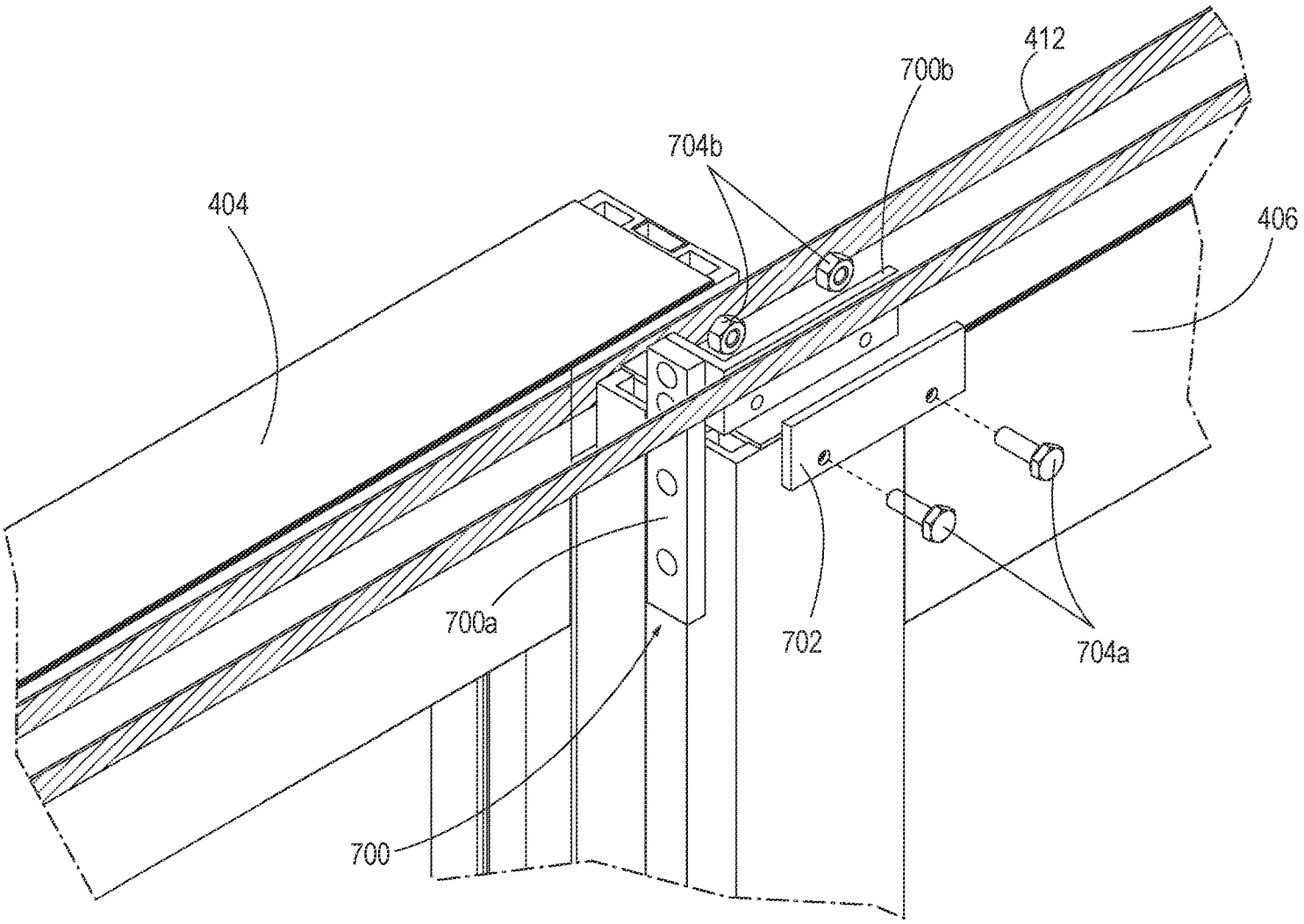
FIG. 7*c* shows the clamping arrangement of FIGS. 7*a* and 7*b* in a partially assembled configuration with the drive belt of FIG. 4*c*.
Figure 7D:
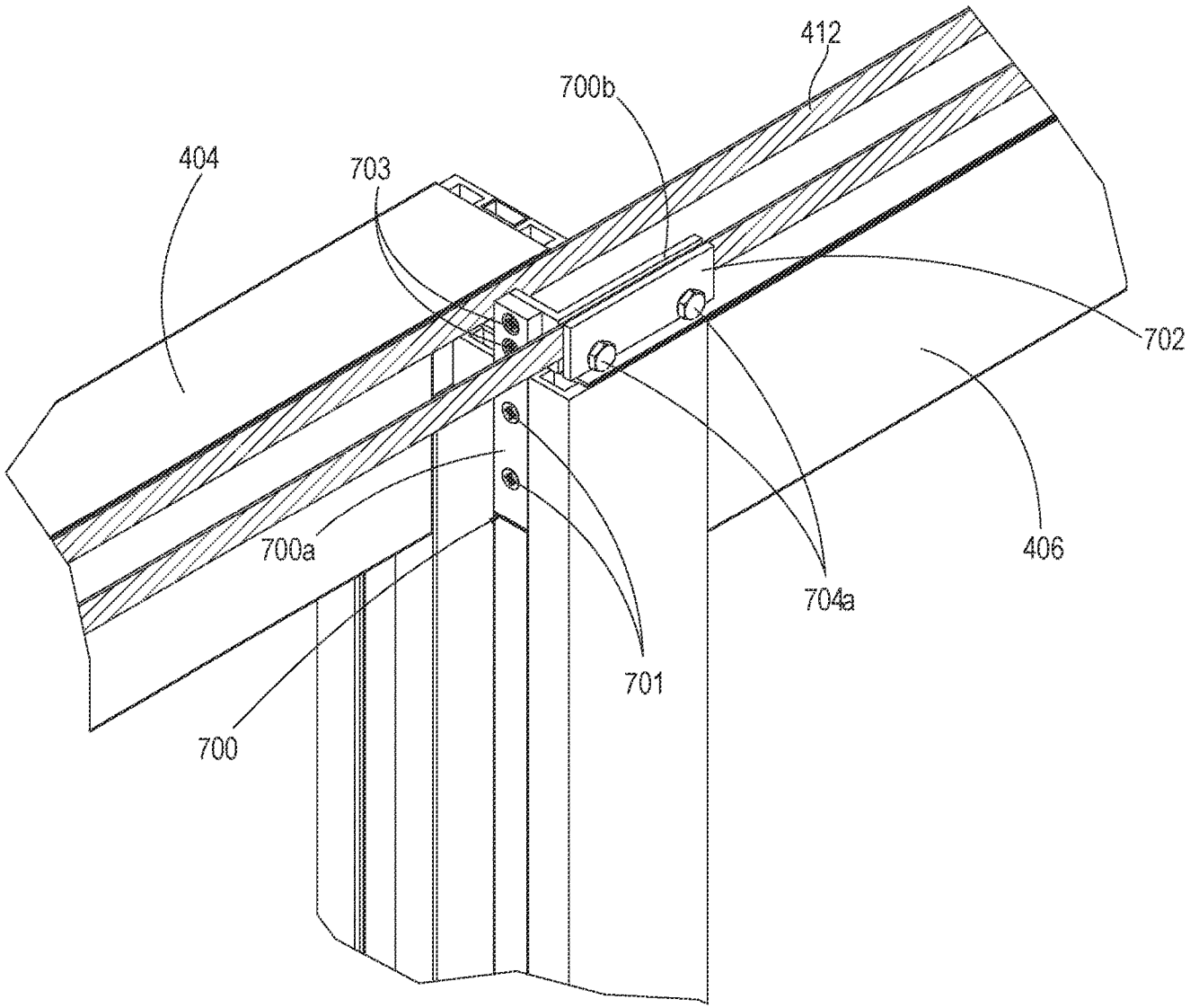
FIG. 7*d* shows the clamping arrangement of FIG. 7*c* in a fully assembled configuration and secured to the drive belt.

FIGS. 7*a* to 7*d* show details of a secure clamping arrangement between the belt 412 and the moving door panel 406 that secures the moving panel 406 to a certain section or portion of the drive belt 412. The clamping arrangement includes a bracket 700 and a clamp 702. The bracket 700 has a first portion 700*a* and a second portion 700*b* that may be connected with fasteners 703. The first portion 700*a* is configured to be fixed to a side 406*a* (e.g., the left side in FIGS. 7*a* to 7*d*) of the moving door panel 406, near a top corner 406*b* of the moving door panel 406, with fasteners 701, so that an upper portion 700*b* of the bracket 700 extends into one of the channels 414 in alignment with an inner side of the belt 412, as shown in FIGS. 7*c* and 7*d*. As shown in FIG. 7*c*, the clamp 702 can be positioned on an outer side of the belt 412, opposite the second portion 700*b*. Then, as shown in FIG. 7*d*, the clamp 702 can be secured with fasteners 704*a* and 704*b* to the second portion 700*b* to securely clamp the belt 412 between the clamp 702 and the second portion 700*b* of the bracket 700. As a result of the secure connection between the belt 412 and the bracket 700, and between the bracket 700 and the moving door panel 406, the belt 412 and the moving door panel 406 can move in unison.

Figure 8:
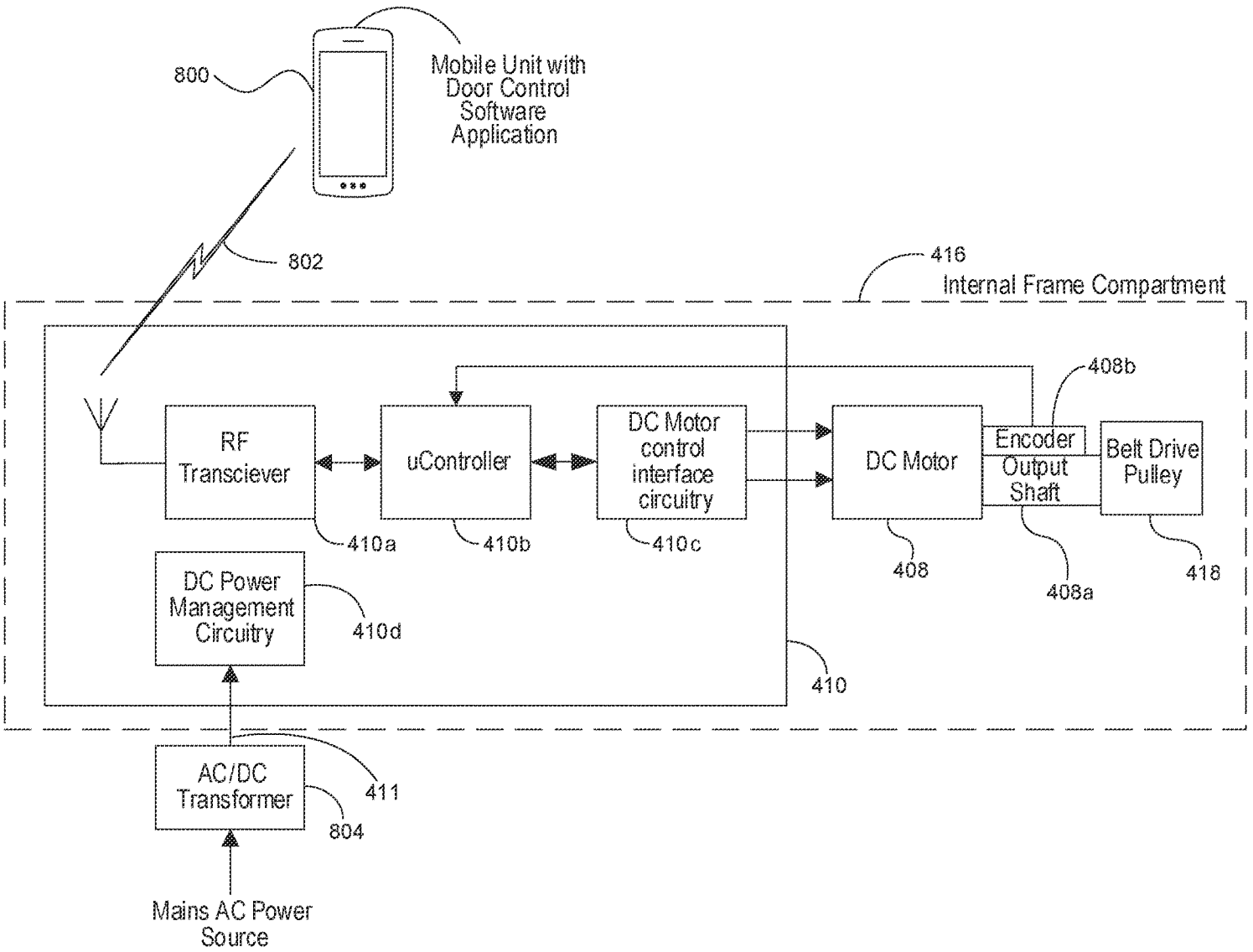
FIG. 8 is a block diagram showing connections between components of the sliding door assembly of FIG. 4*a*.

FIG. 8 shows further details of the motor 408 and the wireless motor controller 410. The wireless motor controller 410 includes an RF interface 410*a* that is configured for wireless communication to a remote device 800, and controller circuitry 410*b*, which may include a microcontroller that includes a processor and memory with programmable input/output peripherals. The RF interface 410*a* and the controller circuitry 410*b* cooperate to receive commands 802 for operating the sliding door assembly 400 communicated from the remote device 800. The remote device 800 may be any computing device having a wireless RF interface capable of communicating with the RF interface 410*a*. In one embodiment, the remote device 800 may be a dedicated remote controller. Alternatively, the remote device 800 may also be any of a cellular telephone, a desktop or laptop computer, tablet computer, and the like having RF communication capability and programmed to wirelessly communicate commands to the RF interface 410*a*.

The wireless motor controller 410 further includes motor control interface circuitry 410*b* operably coupled between the controller circuitry 410*b* and the electric motor 408 for electrical control of the electric motor 408. Such electric control may include controlling the polarity and voltage applied to the electric motor 408 to control the speed and direction of the rotation of the output shaft 408*a* of the motor 408. As noted above, the motor 408 may include a DC motor and the motor control interface circuitry 410*c* may include an H-bridge to control the polarity (and thus the rotational direction) of the motor 408. Also, the motor control interface circuitry 410*b* may include pulse width modulation (PWM) circuitry to control the voltage input to the motor 408 to control the speed of the motor 408.

A rotary encoder 408*b* is coupled to the output shaft 408*a* of the motor 408 to monitor the rotational or angular position of the output shaft 408*a*. The output of the encoder 408*b* is fed back to the controller circuitry 410*b*, which can control the electric motor 408 based on the output of the encoder 408*b* (i.e., on an encoder count). Specifically, the controller circuitry 410*b* can use the output of the encoder 408*b* to indirectly measure the linear position of the moving door panel 406 relative to the frame 402. The rotary position encoder 408*b* is installed on the output shaft 408*a* of a rotary motor 408 to monitor the shaft position of the output shaft 408*a*. The encoder 408*b* provides an output corresponding to the rotation of the shaft 408*a*, either in terms of voltage pulses when using incremental encoders, or absolute angular position when using absolute encoders. The controller circuitry 410*b* can convert this encoder output data into a linear length of travel of the moving door panel 406, which can then be added to the initial position to determine a final position.

Thus, a rotational displacement of the output shaft 408*a* will correspond to a certain linear displacement of the drive belt 412 (and, therefore, the moving door 406) due to the interface between the first pulley 418 and the drive belt 412 and the secure connection between the moving door panel 406 and the drive belt 412. Thus, by monitoring the rotational displacement of the output shaft 408*a* relative to a default rotational position (i.e., counting the number of rotations of the output shaft 408*a*), it is possible to accurately know the position of the moving door panel 406 within the door frame 402 relative to an initial or default position of the moving door panel 406 corresponding to the default rotational position (i.e. a closed position shown in FIG. 4*a*).

As noted above, the electrical motor 408 may comprise a direct-current (DC) motor. The interface circuitry 410*c* may comprises an H-bridge switching circuit that is controlled by electrical signals supplied by the controller circuitry 410*b*. As shown in FIG. 8, the sliding door assembly 400 may also include an electrical power source 804 that supplies DC power signals to the wireless motor controller 410. The electrical power source 804 may comprises an AC-DC transformer that receives mains alternating-current (AC) power and outputs DC power to the wireless motor controller 410. Specifically, in one embodiment, the wireless motor controller 410 may include power management circuitry 410*d* that receives the DC power supplied by the electrical power source 804 and controls the supply of the DC power to the electrically powered components 410*a*, 410*b*, and 410*c* of the wireless motor controller 410. As shown in FIG. 8, the wireless motor controller 410 is electrically connected to the motor 408 and regulates power to the motor 408.

The sliding door assembly 400 can be operated as follows. Assuming that the moving door panel 406 is initially in a closed position shown in FIG. 4*a*, a user may move the moving door panel 406 to the open position by sending a command to the wireless motor controller using the remote device 800. The RF interface circuitry 410*a* receives the command and outputs the command to the controller circuitry 410*b*. The controller circuitry 410*b* will retrieve the last stored encoder count to determine an initial position of the moving door panel 406 before moving and will then output instructions to the motor control interface circuitry 401*c* to open the moving door panel 406. The motor control interface 410*c* can then convert the instructions from the controller circuitry 410*b* to a polarity and a voltage output to the motor 408, which will cause the motor 408 to rotate the output shaft 408 in a certain rotational direction at a certain speed. As the output shaft 408*a* rotates, the first pulley 418 will rotate and move the drive belt 412 along with the moving door panel 406 clamped to the drive belt 412. Also, as the output shaft 408*a* rotates, the encoder 408*b* will output the encoder signal to the controller circuitry 410*b* so that the position of the moving door panel 406 can be monitored as it moves. When the encoder 408*b* outputs a signal to the controller circuitry 410*b* corresponding to the fully open position of the moving door panel 406, the controller circuitry 410*b* sends a signal to the motor control interface circuitry 410*c* to stop the motor 408. The control interface circuitry 410*c* in turn changes the voltage setting to the motor 408 to zero volts, which turns the motor 408 OFF. The foregoing process can be reversed to close the moving door panel 406 once the user sends a command using the remote controller 800 to close the moving door panel 406.

The controller 410 may be configured to detect whether the moving door 4006 has hit an obstruction in the path of the moving door panel 406. In one embodiment, the controller circuitry 410*b* is configured to monitor the current drawn by the motor 408 when the motor 408 is ON. Normally, when the motor 408 is ON and the output shaft 408*a* is rotating to move the moving door panel 406, the current used by the motor 408 is within a certain range. However, when the moving door panel 406 hits an obstruction that inhibits or stops the moving door panel 406 from moving, the current drawn rises above the certain range, which can be detected by the controller circuitry 410*b* using the motor control interface circuitry 410*c*. When such a rise in current occurs, the controller circuitry 410*b* detects the current rise and determines that the moving door panel 406 has hit an obstruction and then sends a signal to the motor control interface circuitry 410*c* to turn OFF the motor 408 by setting the voltage to zero. Once the motor is OFF, the controller circuitry 410*b* will wait for the count of the encoder 408*b* to stop for a certain amount of time (e.g., 10 seconds). If the encoder count does not change for the certain amount of time, it is determined that a user is not manually moving the door panel 406 and the motor 408 remains OFF, until a user issues another command using the remote controller 800. Similarly, if the count of the encoder continues to change once the motor is OFF, it is assumed that the movement of the door panel 406 is caused by manual operation of the door by the user, in which case the motor 408 also remains OFF, regardless of instructions from the remote controller 800.

The sliding door assembly 400 can be installed into a rough opening of a building, such as rough opening 102, which has been provided with access to electrical connections to the AC/DC transformer 804 that is powered by a mains AC power source, as shown in FIG. 8. The sliding door assembly 400 can be positioned in the rough opening 102 and leveled/plumbed in the rough opening 102. Then, the frame 402 can be secured to framing members that define the rough opening 102. For example, fasteners (e.g., screws or nails) can be introduced into and through side jamb portions 402*a* and 402*b* to secure them to corresponding side members of the rough opening 102. Also, fasteners (e.g., screws or nails) can be introduced into an through the sill portion 402*c*, and head jamb portion 402*d* to secure them to corresponding sill and head jamb portions of the rough opening 102. The connection between the wires 411 of the wireless motor controller 410 to the AC/DC transformer 804 may be made before or after the frame 402 is positioned in the rough opening 102.

There have been described and illustrated various embodiments of a sliding door and a method of use. While particular embodiments have been described, it is not intended that the invention be limited thereto, as it is intended that the invention be as broad in scope as the art will allow and that the specification be read likewise. Thus, while particular drive components for moving a sliding door have been disclosed, it will be appreciated that other drive components may be used as well. For example, while particular types of motors and controllers have been disclosed, it will be understood that other suitable motors and controllers having the same functionality can be used. For example, and not by way of limitation, an AC motor and control may be used in place of a DC motor and controller. Also, while a geared drive belt is preferred, it will be recognized that a smooth drive belt may be used as well. It will therefore be appreciated by those skilled in the art that yet other modifications could be made to the provided invention without deviating from its spirit and scope as claimed.

What is claimed is:

1. A sliding door assembly comprising:

a frame that supports and interfaces directly to a fixed door panel and a moving door panel, wherein the frame includes opposed side jamb portions, a sill portion, and head jamb portion opposite the sill portion;

an electric motor;

a wireless motor controller; and a drive belt that is operably coupled to the moving door panel, wherein the drive belt is driven by the electric motor under control of the wireless motor controller;

wherein the head jamb portion includes at least one internal channel that accommodates the drive belt;

wherein one of the side jamb portions includes a top part opposite a bottom part, wherein the top part of the one side jamb portion is disposed adjacent the head jamb portion, wherein the top part of the one side jamb portion has a first internal compartment that houses the electric motor and the wireless motor controller, wherein a bracket is disposed inside the first internal compartment and configured to mount the electric motor to the top part of the one side jamb portion inside the first internal compartment, wherein the bracket is secured to the top part of the one side jamb portion by a plurality of fasteners accessed within the first internal compartment, wherein the top part of the one side jamb portion further includes a first opening and a second opening, wherein the first opening allows for passage of the drive belt between the first internal compartment and the internal channel that accommodates the drive belt, and wherein the second opening is oriented parallel to the fixed door panel and the moving door panel and exposes the first internal compartment and receives a removable access panel; and wherein the removable access panel is removably fixed to the one side jamb portion and has first and second configurations, wherein in the first configuration the access panel is fixed to the one side jamb portion and covers the second opening, and wherein in the second configuration the access panel is disconnected from the one side jamb portion to allow access to the internal compartment through the second opening and to the electric motor and the plurality of fasteners and the wireless motor controller disposed therein.

2. A sliding door assembly according to claim 1, further comprising:

first and second guide pulleys that guide movement of the belt between two fixed points that are spaced apart from one another and aligned with the at least one internal channel of the head jamb portion.

3. A sliding door assembly according to claim 2, wherein:

a particular one of the first and second guide pulleys is coupled to an output shaft of the electric motor and interfaces to the drive belt such that the drive belt moves in conjunction with rotation of the output shaft of the electric motor.

4. A sliding door assembly according to claim 3, wherein:

the particular one of the first and second guide pulleys is housed within the first internal compartment of the one side jamb portion.

5. A sliding door assembly according to claim 3, wherein:

the other side jamb portion has a top part opposite a bottom part, wherein the top part of the other side jamb portion is disposed adjacent the head jamb portion, and wherein the top part of the other side jamb portion has a second internal compartment that houses the other one of the first and second guide pulleys.

6. A sliding door assembly according to claim 5, wherein:

the top part of the other side jamb portion includes a third opening that allows for passage of the drive belt into the second internal compartment.

7. A sliding door assembly according to claim 1, wherein:

the frame is secured to structural members of a building structure, wherein the structural members provide a four-sided opening that supports the frame.

8. A sliding door assembly according to claim 1, wherein:

the wireless motor controller includes an RF interface for wireless communication to a remote device and controller circuitry, wherein the RF interface and controller circuitry cooperate to receive commands for operating the sliding door assembly communicated from the remote device.

9. A sliding door assembly according to claim 8, wherein:

the wireless motor controller further includes interface circuitry operably coupled between the controller circuitry and the electric motor for electrical control of the electric motor.

10. A sliding door assembly according to claim 9, wherein:

the electric motor comprises a DC motor; and the interface circuitry comprises an H-bridge switching circuit that is controlled by electrical signals supplied by the controller circuitry.

11. A sliding door assembly according to claim 8, wherein:

the electric motor includes a shaft encoder that supplies feedback signals to the controller circuitry, wherein the feedback signals are used by the controller for electrical control of the electric motor.

12. A sliding door assembly according to claim 1, further comprising:

an electrical power source the supplies DC power signals to the wireless motor controller.

13. A sliding door assembly according to claim 12, wherein:

the electrical power source comprises an AC-DC transformer.

14. A method of operating a sliding door assembly, the method comprising:

a) providing a sliding door assembly comprising:

a frame that supports and interfaces directly to a fixed door panel and a moving door panel, wherein the frame includes opposed side jamb portions, a sill portion, and head jamb portion opposite the sill portion;

an electric motor;

a wireless motor controller; and a drive belt that is operably coupled to the moving door panel, wherein the drive belt is driven by the electric motor under control of the wireless motor controller;

wherein the head jamb portion includes at least one internal channel that accommodates the drive belt;

wherein one of the side jamb portions includes a top part opposite a bottom part, wherein the top part the one side jamb portion is disposed adjacent the head jamb portion, wherein the top part of the one side jamb portion has an internal compartment that houses the electric motor and the wireless motor controller, wherein a bracket is disposed inside the internal compartment and configured to mount the electric motor to the top part of the one side jamb portion inside the internal compartment, wherein the bracket is secured to the top part of the one side jamb portion by a plurality of fasteners accessed within the first internal compartment, wherein the top part of the one side jamb portion further includes a first opening and a second opening, wherein the first opening allows for passage of the drive belt between the internal compartment and the internal channel that accommodates the drive belt, and wherein the second opening is oriented parallel to the fixed door panel and the moving door panel and exposes the internal compartment and receives a removable access panel; and wherein the removable access panel is removably fixed to the one side jamb portion and has first and second configurations, wherein in the first configuration the access panel is fixed to the one side jamb portion and covers the second opening, and wherein in the second configuration the access panel is disconnected from the one side jamb portion to allow access to the internal compartment through the second opening and to the electric motor and the plurality of fasteners and the wireless motor controller disposed therein;

b) wirelessly receiving a door movement command to move the door from a first position to a second position;

c) in response to receiving the door movement command, d) applying power to the electric motor to drive the drive belt in a direction to move the moving door in a direction from the first position towards the second position; and d) reconfiguring the access panel from the first configuration to the second configuration to access the internal compartment through the second opening and access the electric motor and the plurality of fasteners and the wireless motor controller disposed therein for maintenance or repair.

* * * * *